United States Patent [19]

Bolmstedt et al.

[11] Patent Number: 4,706,741

[45] Date of Patent: Nov. 17, 1987

[54] HEAT EXCHANGER OF FALLING FILM TYPE

[75] Inventors: Ulf Bolmstedt, Staffanstorp; Bengt Lundblad, Malmö, both of Sweden

[73] Assignee: Alfa-Laval Food & Dairy Engineering AB, Lund, Sweden

[21] Appl. No.: 829,654

[22] PCT Filed: Apr. 10, 1985

[86] PCT No.: PCT/SE85/00167

§ 371 Date: Nov. 29, 1985

§ 102(e) Date: Nov. 29, 1985

[87] PCT Pub. No.: WO85/04949

PCT Pub. Date: Nov. 7, 1985

[30] Foreign Application Priority Data

Apr. 18, 1984 [SE] Sweden ..... 8402163

[51] Int. Cl.[4] ..... F28D 5/02

[52] U.S. Cl. ..... 165/115; 165/166; 159/49; 159/13.1; 202/236

[58] Field of Search ..... 165/166, 115; 159/13.1, 159/49; 202/236

[56] References Cited

U.S. PATENT DOCUMENTS

| | | | |
|---|---|---|---|
| 2,872,165 | 2/1959 | Wennerberg | 165/166 X |
| 3,111,982 | 11/1963 | Ulbright | 165/166 |
| 3,371,709 | 3/1968 | Rosenblad | 165/115 |
| 3,496,996 | 2/1970 | Osdor | 165/115 X |
| 4,180,129 | 12/1979 | Sumitomo | 165/166 X |
| 4,182,410 | 1/1980 | Yoshida et al. | 165/166 X |

FOREIGN PATENT DOCUMENTS

| | | | |
|---|---|---|---|
| 883006 | 6/1943 | France | 165/166 |
| 901914 | 7/1962 | United Kingdom | 165/166 |
| 959020 | 5/1964 | United Kingdom | 165/166 |

*Primary Examiner*—Albert W. Davis, Jr.
*Assistant Examiner*—Peggy Neils
*Attorney, Agent, or Firm*—Cyrus S. Hapgood

[57] ABSTRACT

In a heat exchanger of falling film type comprising heat exchange plates with area enlarging corrugation forming ridges and valleys extending in the falling film direction, repeated redistribution of the falling film is brought about by having the ridges and the valleys extending continuously within each of a number of zones formed one after the other in the falling direction, whereas the ridges and the valleys with regard to two consecutive zones are laterally displaced in relation to each other such that the ridges and the valleys, respectively, in one zone extend in alignment with the valleys and the ridges, respectively, in a consecutive zone.

8 Claims, 4 Drawing Figures

HEAT EXCHANGER OF FALLING FILM TYPE

Figure 1:
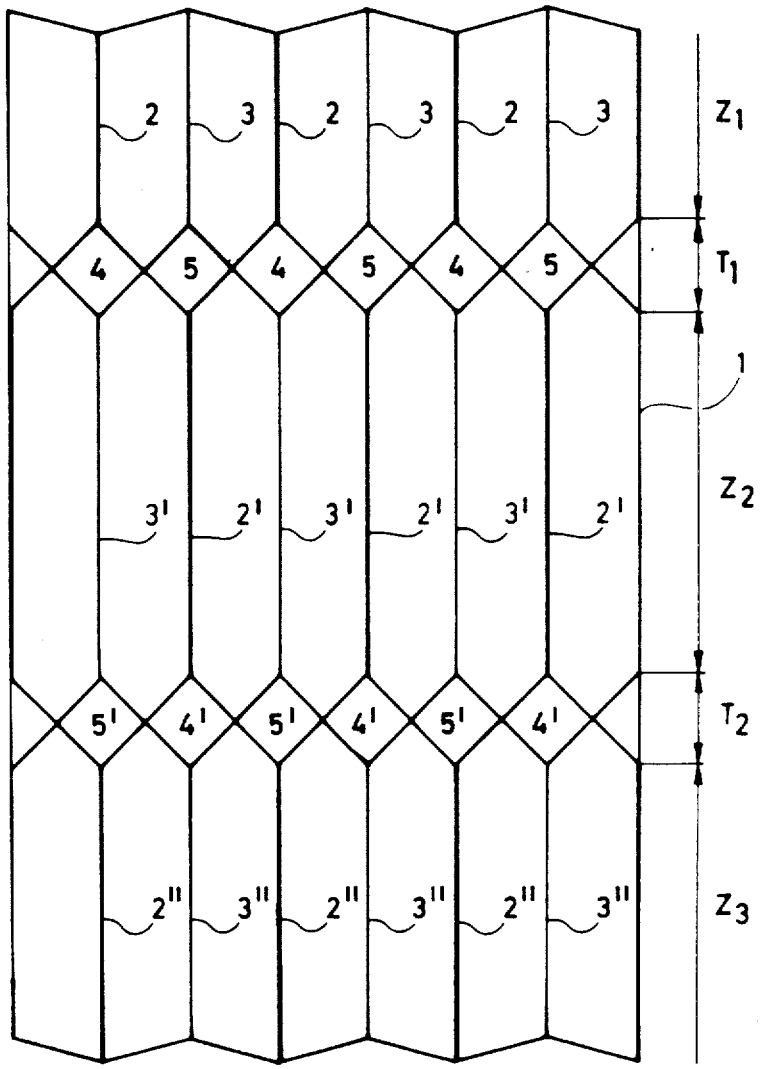

This invention relates to a heat exchanger or falling film type comprising heat exchange plates with corrugations forming ridges and valleys extending in the falling film direction and enlarging the surface areas of the plates as compared with flat plates of the same size.

When designing heat exchange surfaces for falling film apparatuses like falling film coolers and falling film evaporators, for obtaining highest possible heat transfer between the falling film and the medium that is heat exchanged with the falling film, it is important to bring about a complete film cover of the falling film surfaces along the whole falling distance at the same time as the film shall be as thin as possible. Besides the problem to satisfy these two contradictory wishes, also other unfavourable, constructive considerations regarding the practical design of a plate heat exchanger have to be made for maintaining an even and unbroken falling film. Thus, interruptions and resulting unevennesses in the heat transfer surface have often to be made for instance for forming supporting points between two adjacent plate elements. Such supporting points in most heat exchanger cases can be positively utilized for turbulence generation but in the falling film case they constitute an obstacle for the formation of an unbroken film along the heat transfer surface. Prior falling film technics show also examples of so serious disturbance of the falling film owing to bar elements arranged between the falling film surfaces that the bar elements at the same time have to be designed like and serve as a redistributor of the liquid film. The repeated slow down and acceleration of the falling liquid connected therewith lead to deteriorated heat transfer coefficients along a great part of the total falling distance.

Furthermore, a folded or corrugated surface structure of the heat exchange elements are often desired in order to bring about area enlargement, incresed strength and contact points between adjacent heat exchange elements. Such an area enlarging-corrugations of the plate elements in a falling film heat exchanger with ridges and valleys in the falling film direction, however, result in a further problem since the liquid of the formed falling film tends to be accumulated in the valleys of the corrugations and cause film disruption at the ridges of the corrugations, the heat surface effectively utilized diminishing strongly. The obvious counter-measure to that is to increase the liquid load until the film does not burst any longer, which, however, results in an essentially lower coefficient of thermal conductance and, in the case of falling film evaporators, in a lower evaporation ratio than what would be posssible otherwise.

A purpose with the present invention is to bring about an embodiment of heat exchange plates of a plate heat exchanger of the falling film type, in which the mentioned said area enlarging corrugations of the plate elements are utilized at the same time as the mentioned problem with liquid accumulation in the valleys of the corrugation is eliminated.

A further purpose with the invention is to bring about a plate heat exchanger of falling film type in which the mentioned said area enlarging corrugations of the plate elements are utilized and the problem with liquid accumulation in the valleys of the corrugation is eliminated at the same time as the need of supporting points in the falling film passages is eliminated.

A special purpose with the invention is to bring about a falling film evaporator of plate type in which the mentioned said area enlarging corrugations of the plate elements are utilized and the problem with liquid accumulation in the valleys of the corrugation is eliminated at the same time as the corrugation pattern of the plates is utilized in order to bring about evaporation passages with widening cross-section and diminishing heat transfer surface in the falling film direction.

These purposes, according to the invention, are attained in a heat exchanger of the kind mentioned by way of introduction, which is principally characterized in that the ridges and the valleys formed by the corrugations of the heat exchanger plate extend continuously within each of a number of zones formed one after the other (consecutively) in the falling direction, that the ridges and the valleys of two consecutive zones are laterally displaced in relation to each other so that the ridges and the valleys, respectively, in one zone extend in alignment with the valleys and the ridges, respectively, in a consecutive zone, and that the corrugations of the plate in the transition passage between two consecutive zones form connection surfaces for continuous liquid film flow from the lower end of the ridges and the valleys, respectively, in one zone to the upper end of the valleys and the ridges, respectively, in the consecutive zone.

According to the invention the problem with the accumulation of the falling film liquid in the valleys of the plate corrugation is sloved by a distribution, recurring several times along the plate, of the falling film from ridge to valley and from valley to ridge, respectively. At the same time the invention gives a unique possibility to bring about a repeated redistribution of the liquid of a falling film over a long falling distance without the falling liquid having to be slowed down as is the case in known falling film apparatuses, in which even distribution along a long falling distance is brought about by accumulating the liquid after certain intervals and by distributing the liquid again along the falling film surface by slit means. The last-mentioned way to redistribute the falling film, as has been mentioned above, is impaired by the drawback that the falling velocity reduced by the re-starts gives lower heat transfer coefficients along the distances where the falling film has to be accelerated up, during laminar flow, to velocities within the turbulent field which give higher heat transfer coefficients. The solution according to the invention is particularly advantageous since the redistribution mechanics does not require particular means and expensive mounting of the distribution means but can be wholly incorporated in the plate pattern by for instance conventional pressing of the plates.

The different zones in the falling directions between which redistribution between ridge and valley occurs have for simplicity reasons suitably uniform corrugations within each zone over the whole plate width, even if change between ridge and valley, of course, can occur on different height levels along different portions of the plate width. In the transition passages between two zones the corrugation pattern of the plates forms a number of transfer surfaces which, alternating in the cross-direction of the plate, slope towards the falling line in one direction in order to connect a ridge with a valley and in the opposite direction with the falling line in order to connect a valley with a ridge.

The invention make a good film cover possible over a falling film plate with corrugation ridges and valleys in the falling direction in plate lengths of several meters. The length of each zone with continuous ridges and valleys varies with selected corrugation pattern. As an example can be mentioned that, during practical experiments, with a wave length or graduation of the corrugation across the plate of 25–50 mm and a corrugation height between ridge top and valley bottom of 10–15 mm about there zones/meter have appeared to give excellent liquid distribution for a thin, continuous film. This can also be expressed so that the distribution problem has been eliminated according to the invention for long heat transfer plates, exceeding one meter in length, by the fact that the falling film is redistributed by means of at least two changes between ridge and valley along the plate length, i.e. by the fact that the falling film surface at least comprises three zones in the falling direction with intermediate redistribution between ridges and valleys.

It is understood that the invention can be generally applied to all types of falling film apparatuses of plate type like falling film coolers and falling film evaporators. In the case of falling film evaporators, besides the mentioned general advantages with area enlargement and supporting point arrangement, the corrugation pattern with valleys and riges in the falling direction can also be utilized for birnging about evaporation channels with increasing cross-section area and diminishing heat transfer area in the falling direction. Such an evaporator is described in Swedish Pat. No. 424.143 of the applicant. Therefore, in the following the invention shall be further illustrated by a plate evaporator described by example with reference to the accompanying drawing, in which FIG. 1 shows a schematical, partial view of a heat exchange plate according to the invention, FIG. 2 shows a partial view of a horizontal section through an upper part of a plate pile of a plate evaporator, FIG. 3 shows a partial view of a vertical section through a plate evaporator according to FIG. 2, and FIG. 4 shows a partial view of a further horizontal section through a lower part of the plate pile according to FIG. 2.

FIG. 1 shows the principal design of a heat exchange plate 1 for a falling film heat exchanger according to the invention, The plate 1 is corrugated such that ridges 2, 2', 2'' and intermediate valleys 3, 3', 3'', defined with regard to a falling film passage formed between the plate 1 and an adjacent plate, are formed in the falling film direction. The ridges 2 and the valleys 3 extend continuously within a zone $Z_1$ like the ridges 2' and the valleys 3' within a successive zone $Z_2$ and the ridges 2'' and the valleys 3'' within a zone $Z_3$. In transition zone $T_1$, between the zones $Z_1$ and $Z_2$ a number of transition surfaces 4 are formed, which connect the lower end of the ridges 2 in the zone $Z_1$ with the upper end of the valleys 3' in the zone $Z_2$. The transition surfaces 4 alternate in the cross-direction of the plate 1 with transition surfaces 5, which connect the lower end of the valleys 3 in the zone $Z_1$ with the upper end of the ridges 2' in the zone $Z_2$, it being understood that each of the alternate surfaces 4 and 5 forms a certain angle in its direction with regard to the falling direction. Corresponding transition surfaces 4' and 5' are formed in a transition zone $T_2$ between the zones $Z_2$ and $Z_3$ etc. It ought to be observed that the corrugation of the plate 1 ought not to contain sharp folds, but ridge tops and valley bottoms are suitably made with radii in the field of size of 6–10 mm and the connection between the transition surfaces 4 and 5 and respective ridges and valleys ought to be made with a radius excedding 2 mm.

Figure 2:
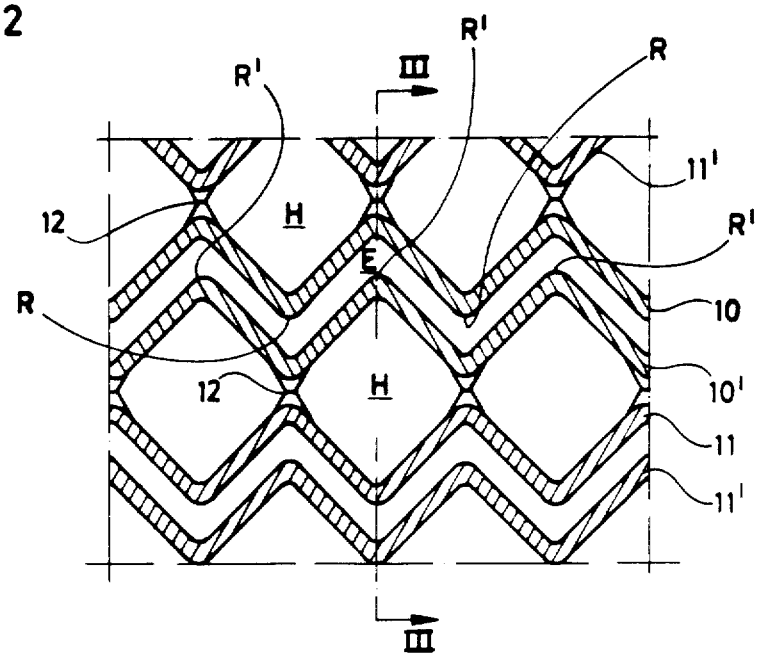
Figure 4:
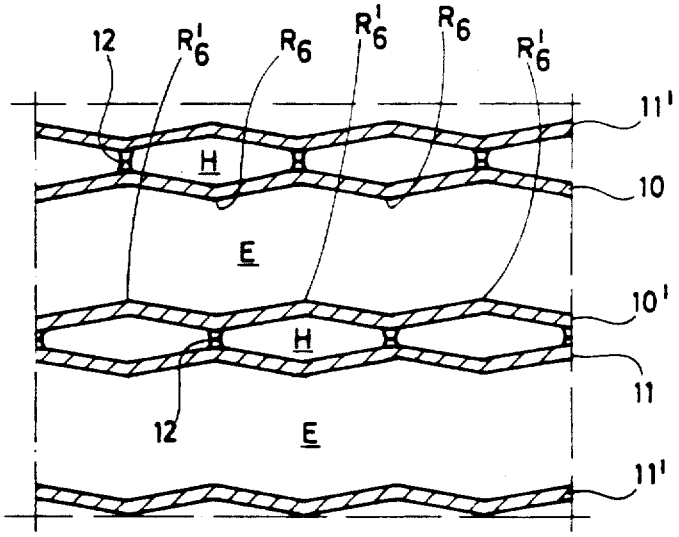
Figure 3:
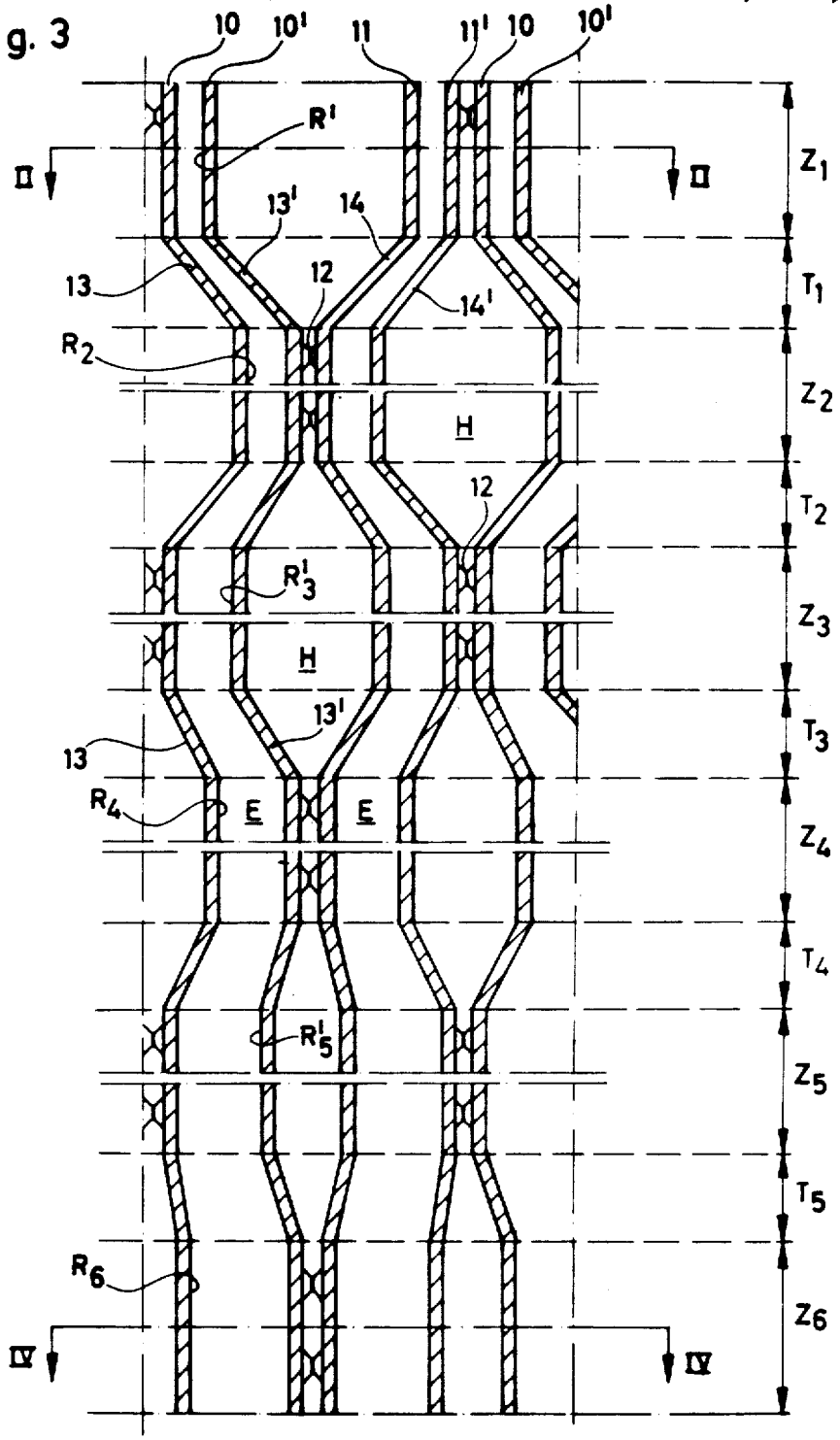

FIG. 2–4 show how a number of plates formed according to the invention are oriented in relation to each other in a particular plate apparatus suitable for falling film evaporation. Two plates 10, 10' and 11, 11', respectively, which between themselves form a falling film passage E, are oriented in relation to each other such that the ridges R, R' of one plate extend in alignment with the valleys of the other plate. The two plates 10, 11 and 10', 11', respectively, which between themselves form heat medium passages H, are oriented with their ridges, defined with regard to respective falling film passage, in alignment with each other. In the plate regions between the mentioned ridges, i.e. the regions forming ridges with regard to the heat medium passages, distance elements 12 are arranged.

As is apparent from FIG. 3, each plate along its length is divided into zones $Z_1$–$Z_6$ with intermediate transition zones $T_1$–$T_5$. In each transition zone a number of transition surfaces 13, 13', 14, 14' are arranged for connecting the ridges in one zone with the valleys in the consecutive zone and vice versa. It can be observed that adjacent transition surfaces 13, 13' in two plates 10, 10' forming a falling film passage E extend essentially parallel with each other.

As is apparent from FIG. 3, the height of the ridges $R'$-$R_2$-$R'_3$-$R_4$-$R'_5$-$R_6$ that is, the extent to which they project into the evaporation passage E, decreases from zone $Z_1$ to zone $Z_6$ so that the cross-section area of the evaporation passage in the flow direction, increases from zone to zone. As is best apparent from a comparison between FIG. 2 and FIG. 4, due to the fact also the perimeter of the evaporation passage E, wetted by the falling film, decreases from zone to zone. In FIG. 3 constant ridge height within each zone has been shown, but, of course, the ridge height can also successively decrease within each zone.

Still referring to FIG. 3, it is apparent that two plates 10 and 10' forming a falling film passage E are oriented so that ridges R2, R4 and R6 of plate 10 are directed into valleys of plate 10' while ridges R1, R3 and R5 of plate 10' are directed into valleys of plate 10. However, in the heating medium passage H formed between two plates 10' and 11, the ridges of each plate are directed toward opposing ridges of the other plate. The parts of plate 10' forming ridges R1, R3 and R5 extending into passage E also form valleys in passage H, and the parts of plate 10' forming valleys opposite the ridges R2, R4 and R6 form ridges in passage H.

What is claimed:

1. In a heat exchanger of the falling film type comprising heat exchange plates each having corrugations forming ridges and valleys, said plates being supported with their ridges and valleys extending vertically in the falling direction of the film, said corrugations having the effect of enlarging the surface area of the plate as compared to the surface area of a flat plate of the same size, the improvement in which each plate has a plurality of main zones located one after the other in the falling direction and extending transversely of said direction, each plate also having a transition zone between adjacent main zones, said ridges and valleys extending continuously within each of said main zones, the ridges and valleys in two adjacent main zones being displaced laterally in relation to each other to cause the ridges and valleys in one main zone to extend in longitudinal alignment with the valleys and ridges, respectively, in the adjacent main zone, the plate in said transition zone being devoid of and interrupting said ridges and valleys and forming connection surfaces for continuous liquid film flow from the lower ends of the ridges and valleys in one main zone of said plate to the upper ends of the valleys and ridges, respectively, in the next lower main zone of the plate.

2. The improvement of claim 1, characterized in that the length of each plate in the falling film direction exceeds one meter, each plate having at least three of said main zones.

3. The improvement of claim 1 or claim 2, in which the heat exchange plates are arranged essentially vertically side by side and alternatively delimit falling film passages (E) for a fluid supplied as a falling film in the upper part of said passages and passages (H) for an additional medium which shall exchange heat with said falling film, characterized in that two plates (10, 10') delimiting one of said falling film passages (E) are oriented with the ridges of one plate extending in alignment with the valleys of the other plate in said one film passage.

4. The improvement of claim 3, in which the height of said ridges of two plates delimiting a falling film passage (E) decreases in the falling film direction so that the cross-sectional area of the falling film passage increases in said direction at the same time as the perimeter of said cross-sectional area decreases in said direction, said height being the extent to which said ridges project into said falling film passage.

5. The improvement of claim 3, in which the main part of each falling film passage (E) located inside the outer edges of the two plates delimiting said film passage is devoid of contact points between said last two plates.

6. The improvement of claim 3, in which two adjacent plates delimiting a passage (H) for said additional medium are oriented with their respective ridges in alignment with each other in said last passage (H), said two adjacent plates having respective contact points (12) engaging each other in the regions between said respecitve ridges.

7. The improvement of claim 6, in which the main part of each falling film passage (E) located inside the outer edges of the two plates delimiting said film passage is devoid of contact points between said last two plates.

8. The improvement of claim 4, in which the main part of each falling film passage (E) located inside the outer edges of the two plates delimiting said film passage is devoid of contact points between said last two plates, the two adjacent plates delimiting a passage (H) for said additional medium being oriented with their respective ridges in alignment with each other in said last passage (H), said two adjacent plates having respective contact points (12) engaging each other in the regions between said respective ridges.

* * * * *

UNITED STATES PATENT AND TRADEMARK OFFICE

CERTIFICATE OF CORRECTION

PATENT NO. : 4,706,741

DATED : November 17, 1987

INVENTOR(S) : ULF BOLMSTEDT et al.

It is certified that error appears in the above-identified patent and that said Letters Patent are hereby corrected as shown below:

Col. 1, line 4, change "or" to--of--.

Col. 1, line 41, after "Such" delete--an--.

Col. 3, line 8, change "there" to--three--.

Col. 3, line 26, change "birnging" to--bringing--.

Col. 4, line 32, after "passage" insert--as viewed--.

Signed and Sealed this

Fifth Day of July, 1988

*Attest:*

*Attesting Officer*

DONALD J. QUIGG

*Commissioner of Patents and Trademarks*